US006938601B2

(12) United States Patent
Fukumoto

(10) Patent No.: US 6,938,601 B2
(45) Date of Patent: Sep. 6, 2005

(54) COMBUSTION RESONATOR

(75) Inventor: Ichiro Fukumoto, West Bloomfield, MI (US)

(73) Assignee: Mahle Tennex Industries, Inc., Murfreesboro, TN (US)

( * ) Notice: Subject to any disclaimer, the term of this patent is extended or adjusted under 35 U.S.C. 154(b) by 55 days.

(21) Appl. No.: 10/442,326

(22) Filed: May 21, 2003

(65) Prior Publication Data

US 2004/0231912 A1 Nov. 25, 2004

(51) Int. Cl.[7] ..... F02M 35/10
(52) U.S. Cl. ..... 123/184.57; 181/229
(58) Field of Search ..... 123/184.57; 184/229; 181/229

(56) References Cited

U.S. PATENT DOCUMENTS 3,175,640 A * 3/1965 Matsui ..... 181/252
3,955,643 A * 5/1976 Clark ..... 181/248
4,713,823 A 12/1987 Smith
5,014,816 A 5/1991 Dear et al.
5,106,397 A 4/1992 Jaroszczyk et al.
5,333,576 A 8/1994 Verkleeren
5,572,966 A 11/1996 Doddy et al.
5,602,368 A * 2/1997 Kaneso ..... 181/255
5,628,287 A 5/1997 Brackett et al.
5,783,780 A * 7/1998 Watanabe et al. ..... 181/229
5,839,405 A 11/1998 Falkowski et al.
5,949,989 A 9/1999 Falkowski et al.
6,009,705 A 1/2000 Arnott et al.
6,084,971 A 7/2000 McLean
6,135,079 A 10/2000 Fuesser
6,139,381 A 10/2000 Suzuki et al.
6,196,351 B1 * 3/2001 Clokey et al. ..... 181/252
6,302,752 B1 10/2001 Ito et al.
6,382,161 B1 5/2002 Alex et al.
6,422,192 B1 7/2002 Bloomer

* cited by examiner

*Primary Examiner*—Noah P. Kamen
(74) *Attorney, Agent, or Firm*—Rader, Fishman & Grauer PLLC

(57) ABSTRACT

An intake combustion resonator including an enclosure which includes a resonator tube assembly passing through the enclosure. The resonator tube is formed from porous, undulated tube material and has openings formed in the tube walls. The openings serve as "tuned" passages through the porous tube walls. The resonator tube assembly is not centrally located within the enclosure but rather it is offset both in a height and a width orientation. The size, spacing, and orientation of the tube openings, porous, undulated sleeve material, the design of the enclosure, and the placement of the tube within the enclosure, all act in concert to give rise to the noise abatement properties of the present invention.

22 Claims, 4 Drawing Sheets

COMBUSTION RESONATOR

TECHNICAL FIELD

This invention generally relates to sound suppression devices and more particularly relates to resonators for attenuating sound produced by rotating machinery.

BACKGROUND OF THE INVENTION

It is generally desirable to minimize engine noise generated from internal combustion engines. Typically, this type of noise is reduced or minimized through the use of mufflers (for reducing combustion noise emitted from engine exhaust air) and the use of resonators (for attenuating the noise generated from the engine air intake system).

One common approach to attenuating noise emitted from the intake portion of an engine, is to use resonators constructed from one or more interior chambers which are "tuned" in a way which cancels certain frequency ranges of intake noise. However, tuned resonators involve many design compromises which, invariably, make them inefficient in reducing engine noise at "non-optimum" engine speeds.

A typical resonator includes an air reservoir comprising a fixed volume connected through a neck portion which leads to the intake manifold of an engine. Baffles, tubes and other "tuning" devices are also typically included in a resonator's design. The volume of the resonator and other component dimensions are determined based on numerous factors including sound characteristics desired by the customer, component packaging within the vehicle, the number of engine cylinders, engine size, and other engine and vehicle factors that influence noise volumes and noise frequencies emitted from the air handling system of an engine.

DETAILED DESCRIPTION OF THE PREFERRED EMBODIMENTS

Figure 1:
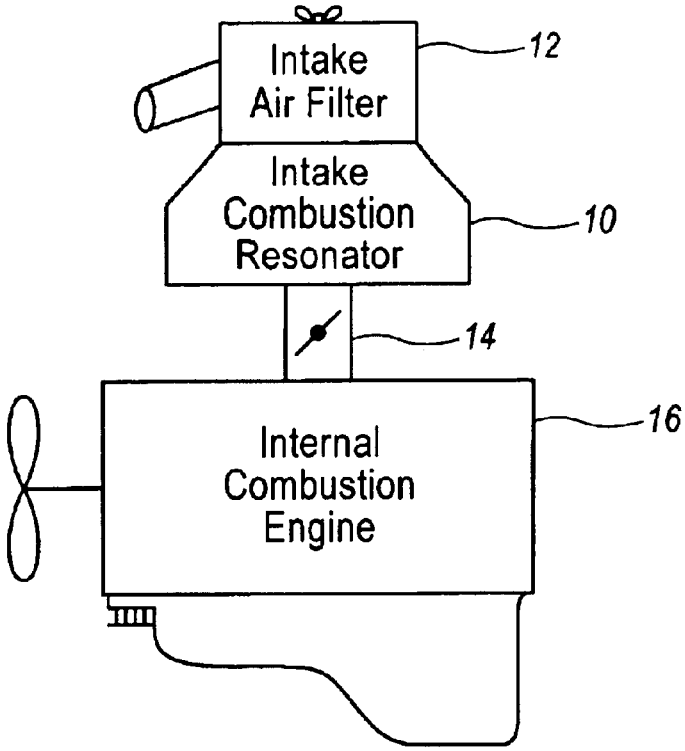
FIG. 1 is an environmental view showing the general environment in which the resonator of the present invention is used.

FIG. 1 is a general environmental view showing the intake combustion resonator 10 of the present invention in the environment in which it typically operates. Specifically, the intake combustion resonator 10 of the present invention is designed to reside between the intake air filter 12 and the throttle body 14 of internal combustion engine 16. It is to be understood that although FIG. 1 depicts the typical placement of intake combustion resonator 10 with respect to intake air filter 12, throttle body 14, and internal combustion engine 16, it is to be understood that many other arrangements of these components could be made without effecting the operation of the present invention. For example, combustion resonator 10 could reside between the air intake filter and the intake duct.

Figure 2:
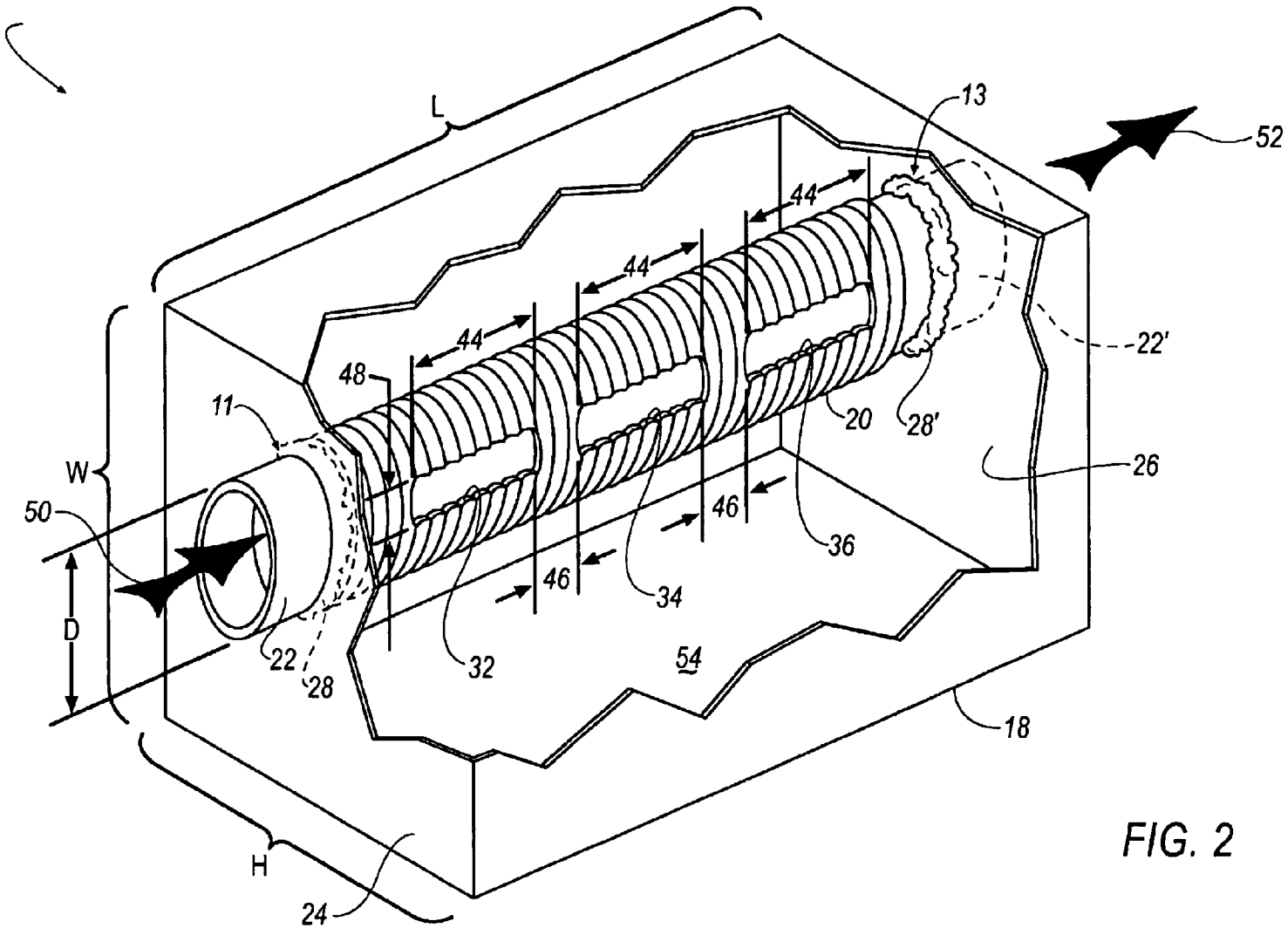
FIG. 2 is an isometric view of an embodiment of the resonator of the present invention.

Now referring to FIGS. 1 and 2, intake combustion air resonator 10 is comprised of two primary components—enclosure 18, and porous tube element 20. End portions 22, 22' of tube element 20 extend through opposing sides 24, 26 of enclosure 18. End portions 22, 22' of tube element 20 are sealed 28, 28' at respective openings 11, 13 through opposing sides 24, 26 of enclosure 18. Sealing 28, 28' can be accomplished by any numerous means well known to those skilled in the art, including the use of adhesives, resins, epoxy, plastic filler, welding, soldering, mechanical fitting, mechanical clamping or the like. Also, it is possible to fabricate end portions 22, 22' of tube 20 and openings 11, 13 of enclosure 18 using sufficiently tight tolerances such that an effective seal is obtained by way of the frictional interference between end portions 22, 22' of tube 20 and opposing sides 24, 26. In such an embodiment, no extraneous sealing means would be needed.

Enclosure 18 is preferably constructed in the general shape of a hexahedron (a three-dimensional, regular polyhedron figure formed by six plane surfaces). Although in order to achieve optimum noise reduction performance for a given application the dimensions of these six surfaces will vary, enclosure 18 was constructed having a Height (H) of 230 millimeters, a Width (W) of 150 millimeters, and a Length (L) of 265 millimeters. Porous tube 20 is comprised of porous, undulated tube material including a series of slotted openings 32 through 42. This aspect of the present invention will be fully described in conjunction with FIG. 4. Slots 32 through 42, are preferably 60 millimeters long 44 and spaced no closer than 20 millimeters 46 to each other. Slots 32 through 42 are preferably five millimeters wide 48. The nominal Diameter (D) of slotted tube 22 is generally 90 millimeters.

Figure 3:
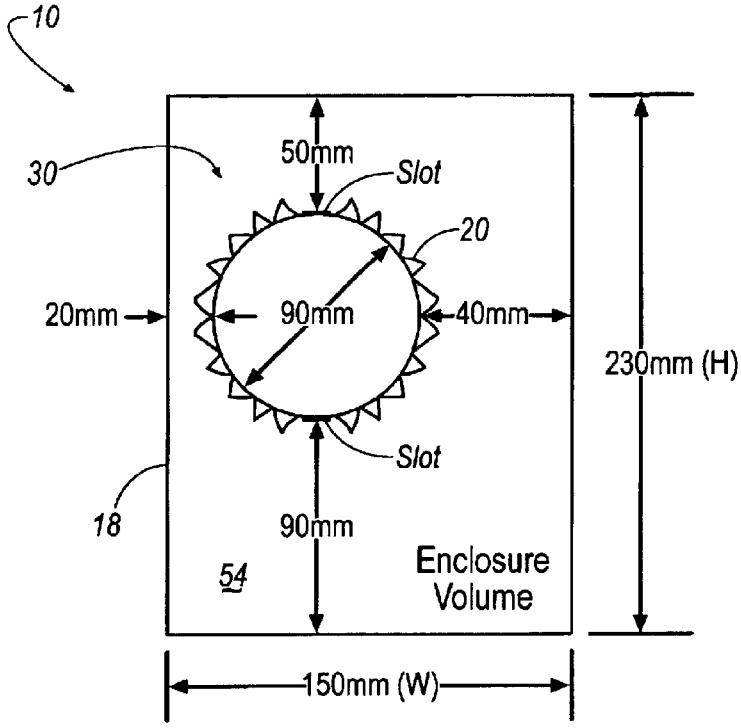
FIG. 3 is a front elevational view of the resonator of FIG. 2.

Now referring to FIGS. 2 and 3, preferably porous tube 20 is oriented within enclosure 18 as shown in FIG. 3. Most notably, this orientation is not centered within enclosure 18, but rather porous tube 20 is offset from center, 20 millimeters in the Height (H) direction and is also offset 10 millimeters in the Width (W) direction. This offset both in the Height direction and the Width direction is most easily seen in FIG. 3 wherein the top of slotted tube 20 is 50 millimeters from the top of enclosure 18 wherein the bottom most portion of slotted tube 20 is 90 millimeters from the bottom of enclosure 18. Likewise, the offset in the Width position is easily detected from FIG. 3 wherein the right most portion of slotted tube 20 is 40 millimeters from the right most portion of enclosure 18 as compared to the left most portion of slotted tube 20 which is only 20 millimeters from the left most portion of enclosure 18. Also, an important aspect of the present invention is the orientation of slots 32 through 42. The orientation of these slots is clearly shown in FIG. 2 and FIG. 3 with respect to the sides of the enclosure. Specifically, in order to achieve optimum noise reduction from the intake combustion resonator 10, slots 32 through 42 should intersect a plane that is generally parallel to the sides of enclosure 18 that form the Height dimension of enclosure 18.

Figure 4:
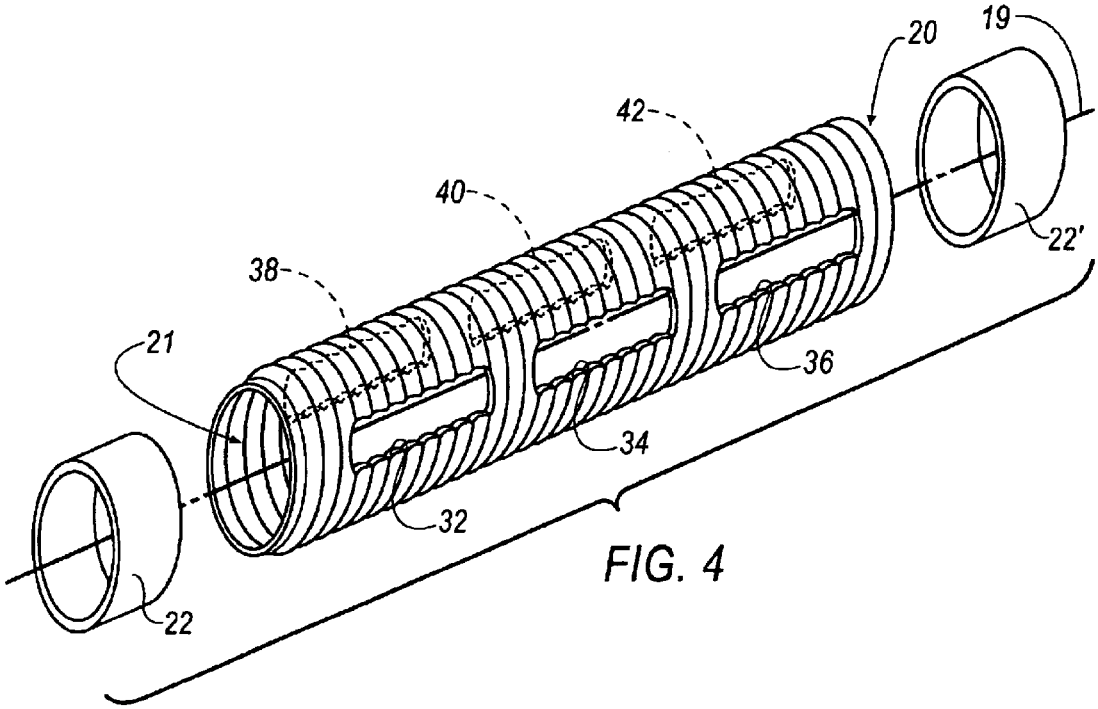
FIG. 4 is an exploded view of the porous tube of FIG. 2.

Now referring to FIGS. 2, 3 and 4, porous tube 20 is preferably constructed from polyester or polyester fibers. Tube 20 is preferably formed using injection molding techniques where the undulating side walls can be easily formed. Other materials such as sintered metal, fiberglass, reinforced resin can be used to fabricate slotted tube 20. One such source of porous tube 20 is Westaflex Brasil. Westaflex sells porous tube material under the trade name of Sonoflex. Sonoflex is distributed in the USA by West Akron North America, Ltd., 571 Kennedy Road, Akron, Ohio 44305. As best shown in FIG. 4, porous tube 20 includes end portions 22 and 22'. End portions 22, 22' can be integrally formed with porous tube 20 or, in the alternative, they can be formed in a separate process from that used to form porous tube 20 and then, at a later time, joined to porous tube 20 by way of adhesives, welding, or any other method compatible with the materials used to fabricate porous tube 20 and end portions 22, 22'. End portion 22, 22' can be fabricated from the same porous material used to fabricate tube 20, or in the alternative, any non-porous material may be used such as plastic metal, fiberglass, or the like.

Porous tube 20 is preferably constructed with undulating side walls for improved noise abatement properties; however, some level of noise abatement is still achieved if porous sleeve tube 20 is not undulated. Porous tube 20 must be fixed to enclosure 18 such that the orientation of slots 32 through 42 do not change relative to the walls of enclosure 18. Preferably, tube slots are arranged in pairs (i.e. [32, 38]; [34, 38]; [36, 42]), wherein at least one slot in each pair of slots lies along a common line generally parallel to a center line 19 of said tube.

When air flows 50, 52 through intake combustion resonator 10, enclosure volume chamber 54 in combination with tube 20 significantly attenuates any objectionable noise created by the pulsating air flow (typically caused by the engine valve train opening and closing). When the resonator components of the present invention are properly sized and oriented (based on the engine application), the system acts as an air spring mass system to effectively cancel objectionable noise.

Figure 5:
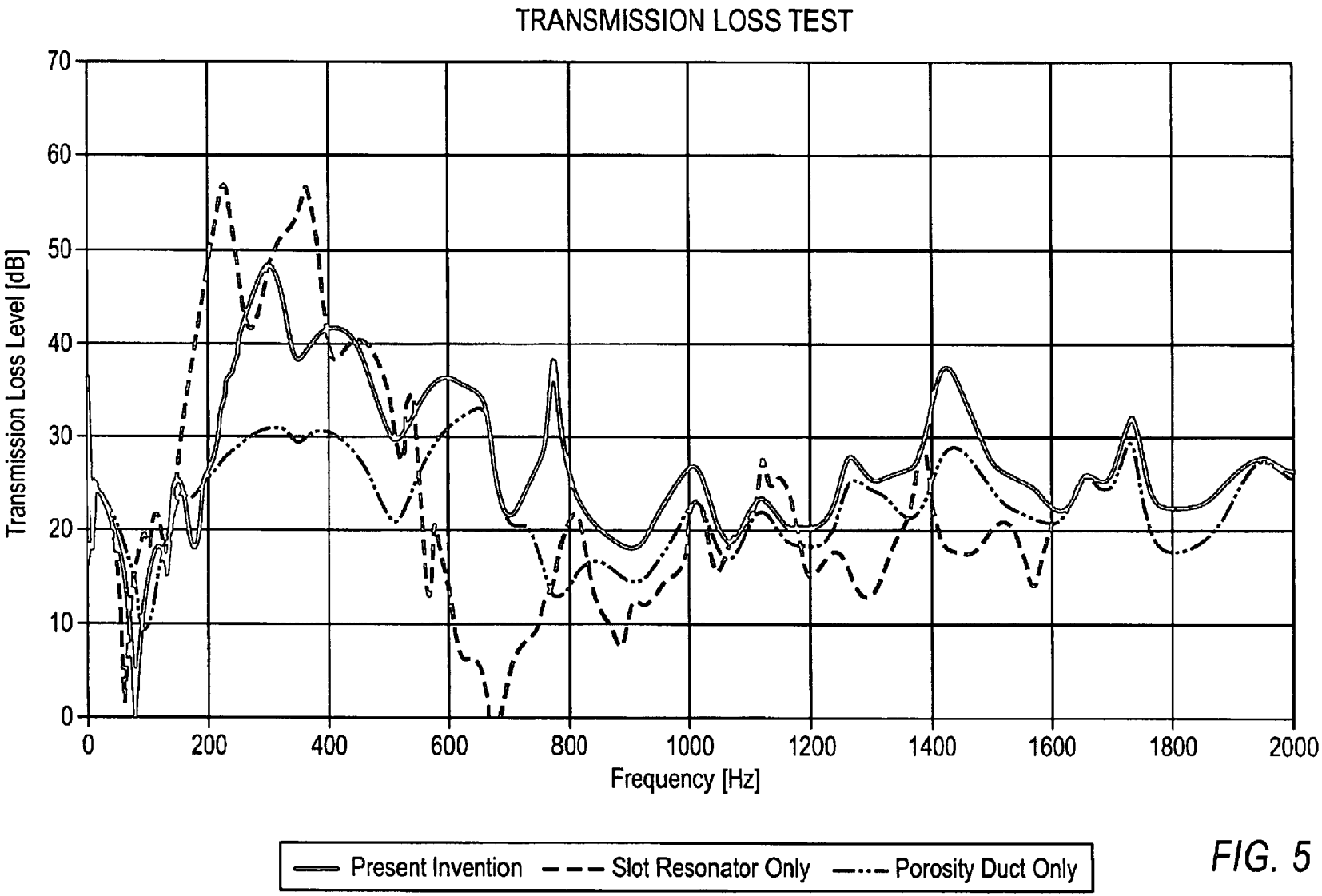
FIG. 5 is a graphical depiction of the noise transmission loss evidenced by the resonator of the present invention, as compared with a simple slot resonator and also as compared with a simple porous duct attenuator.

Now referring to FIG. 5, three noise reduction systems were tested and the results are depicted in FIG. 5. The first system is the system of the present invention. The second system (slot resonator) is a system constructed essentially like the intake combustion resonator of the present invention except that only a non-porous slotted tube was used. The third system tested (porosity duct system) is a system which included an enclosure wherein a porous, non-slotted sleeve was used inside of the enclosure to join intake opening 11 to outlet opening 13. As is seen from FIG. 5, the transmission loss for the system of the present invention is improved over both of the other noise reduction systems especially in the 700 to 2000 Hertz range.

The foregoing detailed description of the invention shows that the specific embodiments of the present invention set forth herein are suited to fulfill the objects of the invention. It is recognized that those skilled in the art may make various modifications or additions to the preferred embodiments to illustrate the present invention, without departing from the spirit of the present invention. Accordingly, it is to be understood that the protection sought to be afforded hereby should be deemed to extend to the subject matter defined in the impending claims, including all equivalents thereof.

REFERENCE NUMERALS

10 Intake combustion resonator
11 intake opening
12 intake opening
13 outlet opening
14 throttle body
16 internal combustion engine
18 enclosure
20 porous tube
21 central opening
22, 22' end portions of tube 20
24 opposing sides of 18
26 opposing sides of 18
28 sealed
30 resonator tube assembly
32 slotted openings in 20 (porous sleeve)
32' slotted openings in 22 (slotted tube)
34 slotted openings in 20 (porous sleeve)
34' slotted openings in 22 (slotted tube)
36 slotted openings in 20 (porous sleeve)
36' slotted openings in 22 (slotted tube)
38 slotted openings in 20 (porous sleeve)
38' slotted openings in 22 (slotted tube)
40 slotted openings in 20 (porous sleeve)
40' slotted openings in 22 (slotted tube)
42 slotted openings in 20 (porous sleeve)
42' slotted openings in 22 (slotted tube)
44 length of slots
46 slot spacing
48 Width of slots
50 air flow
52 air flow
54 enclosure volume chamber

I claim:

1. A resonator, comprising:

an enclosure including one or more walls, wherein said walls define an inside volume and an outside volume, a tube including a wall, said wall defining an inner passage of said tube and an outer surface, of said tube, said tube wall terminating at first and second tube ends, wherein at least a portion of said tube consists of a porous material, wherein at least a portion of said tube resides within said inside volume of said enclosure, and wherein at least a portion of said tube communicates with a first opening in said one or more enclosure walls thereby creating a passageway between said inner passageway of said tube and said outside volume, wherein said tube wall includes at least one opening therethrough forming a passageway between said inner passageway of said tube and said inside volume of said enclosure volume of said enclosure.

2. The resonator of claim 1, wherein said enclosure is a hexahedron.

3. The resonator of claim 2, wherein said enclosure is fabricated from at least one material selected from the group of materials consisting of plastic, metal, or fiberglass reinforced resin.

4. The resonator of claim 2, wherein the hexahedron has four large faces and two small faces, wherein said large faces share a common length dimension which is longer than any dimension of said two small faces.

5. The resonator of claim 4, wherein said respectively associated openings are respectively associated with said two small faces.

6. The resonator of claim 5, wherein said associated openings are not centered with the centers of the two small faces.

7. The resonator of claim 6, wherein the centers of the associated openings are shifted 20 millimeters in a first direction and 10 millimeters in a second direction from the centers of the two small faces, wherein said first and second directions are orthogonal.

8. The resonator of claim 4, wherein the longest dimension of said four large faces is generally 265 millimeters.

9. The resonator of claim 4, wherein the shortest dimension of any one of said four large faces is generally 150 millimeters.

10. The resonator of claim 4, wherein said two small faces are rectangular having first and second pairs of opposing sides, wherein said first pair of sides is longer than said second pair of sides; wherein said first pair of sides is generally 230 millimeters.

11. The resonator of claim 1 wherein said inner passage of said tube includes a generally circular cross section having a diameter generally 90 millimeters.

12. The resonator of claim 1, wherein said at least one opening is elongated forming a slot.

13. The resonator of claim 1, wherein said at least one opening includes at least two openings arranged generally diametrically opposed to one another along a line that passes generally perpendicularly through a center axis of said tube inner passage.

14. The resonator of claim 13, wherein said at least two openings includes two pairs of openings, wherein each pair of openings is arranged such that at least one opening in each pair of openings lies generally along a common line.

15. The resonator of claim 14, wherein an edge portion of each opening is generally not spaced any closer than 20 millimeters from an edge portion of any other opening.

16. The resonator of claim 14, wherein said at least two pairs of openings includes at least three pairs of slotted openings.

17. The resonator of claim 1, wherein said porous material is formed from polyester fibers.

18. The resonator of claim 1, wherein a portion of said tube communicates with a second opening in said one or more enclosure walls.

19. The resonator of claim 1, wherein said tube wall is undulated.

20. The resonator of claim 1, wherein said enclosure is a hexahedron, wherein the hexahedron has four large faces and two small faces, wherein said four large faces share a common length dimension which is longer than any dimension of said two small faces, wherein said two small faces are rectangular each having first and second pairs of opposing sides, wherein said first pair of sides is longer than said second pair of sides.

21. The resonator of claim 1, wherein said opening is disposed within said portion with said porous material.

22. A resonator, comprising:

an enclosure including one or more walls, wherein said walls define, an inside volume and an outside volume, a tube including a wall, said wall defining an inner passage of said tube and an outer surface of said tube, said tube wall terminating at first and second tube ends, wherein at least a portion of said tube is formed from a porous material, wherein at least a portion of said tube resides within said inside volume of said enclosure, and wherein at least a portion of said tube communicates with a first opening in said one or more enclosure walls thereby creating a passageway between said inner passageway of said tube and said outside volume, wherein said tube wall includes at least one opening therethrough forming a passageway between said inner passageway of said tube and said inside volume of said enclosure volume of said enclosure, and wherein said tube wall is undulated.

* * * * *